United States Patent [19]

Ahn

[11] Patent Number: 4,922,766

[45] Date of Patent: May 8, 1990

[54] ELECTRIC FAN APPARATUS

[75] Inventor: Soon-Suk Ahn, Seoul, Rep. of Korea

[73] Assignee: Seong-Do Moon, Kyonggi, Rep. of Korea

[21] Appl. No.: 143,089

[22] Filed: Jan. 12, 1988

[51] Int. Cl.[5] ..... F16H 35/00

[52] U.S. Cl. ..... 74/385; 74/665 GC

[58] Field of Search ..... 74/665 F, 665 GC, 385, 74/425; 165/125; 416/170 R, 170 C, 172; 415/122 R, 122 A, 123, 122.1; 192/65, 76; 219/365, 366, 369, 370

[56] References Cited

U.S. PATENT DOCUMENTS

| | | | |
|---|---|---|---|
| 1,094,541 | 4/1914 | Dilg | 416/100 |
| 1,187,858 | 6/1916 | Olson | 74/425 |
| 1,763,645 | 6/1930 | Caldwell | 74/425 |
| 2,458,159 | 1/1949 | Goldthwaite | 165/125 |
| 4,437,355 | 3/1984 | Bordat | 74/385 |
| 4,472,110 | 9/1984 | Sun Keu | 416/172 |

FOREIGN PATENT DOCUMENTS

| | | | |
|---|---|---|---|
| 948561 | 8/1949 | France | 416/99 |

*Primary Examiner*—Philip H. Leung

*Assistant Examiner*—Geoffrey S. Evans

*Attorney, Agent, or Firm*—Finnegan, Henderson, Farabow, Garrett & Dunner

[57] ABSTRACT

An electric fan apparatus having a rotatable hub member provided in the central portion thereof and surrounded with a bearing housing through a plurality of bearings; a vertical main shaft connected to a motor shaft via a coupling; a rotary member connected to the hub member; a plurality of fan spindles equally disposed on the rotary member and supported by bearing housings; a base member supporting the apparatus; a column vertically fixed on the central portion of the base; a stem member movably inserted into the column; a tilting device contected between the bottom plate of the housing and the top end portion of the stem member; cooperating elements between the coupling fixedly inserted to the motor shaft and a worm wheel shaft arranged in the housing; a clutch mechanism selectively engaging between the worm wheel shaft and a crank device for angularly moving the rotary member; and connecting elements transmitting power between the main shaft and a plurality of the fan spindles capable of being mounted with a plurality of fan impellers for sending the wind to all directions, e.g. 360 degrees.

6 Claims, 6 Drawing Sheets

ELECTRIC FAN APPARATUS

BACKGROUND OF THE INVENTION

The present invention relates to an electric fan apparatus, and more particularly, to an improved electric fan apparatus suitable for employing in a plurality of fan impellers, e.g. three impellers, thus sending the wind generated by the fan impellers to 360 degrees in all directions.

Electric fans have been used for many years for wind cooling in residential, commercial and industrial buildings. At the same time, the typical desk-fan construction wherein one fan impeller forming a plurality of blades is only mounted coaxially with a drive motor permits its air flow to a narrow range even though the fan head may be angularly moved to the right and the left sides.

For that reason, when the fan impeller is angularly moved to direct to the right side, the left side can not be covered with the wind, thus remaining under hot state.

As the same manner, when the fan impeller is angularly moved to direct to the left side, the right side will be under hot state.

Accordingly, the aforementioned desk-fan presents a problem not being able to match with the users' satisfaction because of sending the wind to the narrow range.

In another conventional electric fan, a wind direction shifting plate has been used as means for shifting the direction of a wind generated by a fan impeller rotated by a motor, without shifting the air sending direction by the fan impeller.

In such arrangement, the wind direction shifting plate serves as a guide plate which the wind direction can be changed from one position to other position, however, the width of the wind flow can not be expanded but the wind direction can be only changed, and accordingly the aforesaid electric fan creates a problem the same as the above-described desk-fan.

Thus, none of the aforementioned electric fan apparatus discloses the desired features of the wide wind range in all directions, e.g. 360 degrees, and simple operation and adjustment of the fan itself for widening air flow width, especially in combination with fan apparatus of such manifold construction as to generate warm air flow in case of necessity.

SUMMARY OF THE INVENTION

Accordingly, a general primary objective of the present invention is to provide a novel and improved electric fan apparatus which is so constructed and designed as to overcome the various deficiencies in the aforesaid conventional art.

To this end, an electric fan apparatus in accordance with the present invention comprises a housing including a rotatable hub member provided in the central portion thereof and surrounded with a bearing housing through a plurality of bearings; a vertical main shaft connected to a motor shaft via a coupling a rotary member connected to the hub member a plurality of fan spindles equally disposed on the rotary member and supported by bearing housings, a base member supporting the apparatus; a column vertically fixed on the central portion of the base; a stem member movably inserted into the column; a tilting device connected between the bottom plate of the housing and the top end portion of the stem member; cooperating means between the coupling fixedly inserted to the motor shaft and a worm wheel shaft arranged in the housing; a clutch mechanism selectively engaging between the worm wheel shaft and a crank device for angularly moving the rotary member; and transmitting means connecting between the main shaft and a plurality of the fan spindles capable of being mounted with a plurality of fan impellers for sending the wind to all directions, e.g. 360 degrees.

Another objective is to provide such an electric fan apparatus wherein a plurality of fan spindles, e.g. three spindles to be driven by a vertical main shaft coupled with a drive motor, are able to be mounted with a plurality of fan impellers for adequate air flow volume and cooling area coverage surrounding the fan stand.

A further objective is to provide such an electric fan apparatus wherein a transmitting means connecting between a driving main shaft and a plurality of fan spindles is a friction contact method consisting of conical friction wheels for eliminating noise occurred from the wheels.

An additional objective is to provide such an electric fan apparatus wherein a rotatable hub member connected to a rotary member is movably pivoted at one end of a connecting rod and the other end eccentrically pivoted to a crank disc slidably connected to a clutch mechanism.

Yet another objective is to provide such an electric fan apparatus wherein a clutch mechanism has a manipulating lever for selecting the angular movement of a rotary member.

A still further objective is to provide such an electric fan apparatus wherein a stem member includes a height adjustable device thereon.

Still another objective is to provide such an electric fan apparatus wherein a base member includes a plurality of adjustable legs therein for stabilizing the apparatus.

A still further objective is to provide such an electric fan apparatus wherein a base member includes a water reservoir having heating means for supplying hot water to a circular type radiator being able to be installed to the surrounding of the apparatus for sending warm air flow in all directions.

Additional objects and advantages of the present invention will become evident upon consideration of the following detailed description and accompanying drawings.

DESCRIPTION OF THE PREFERRED EMBODIMENT

Figure 1:
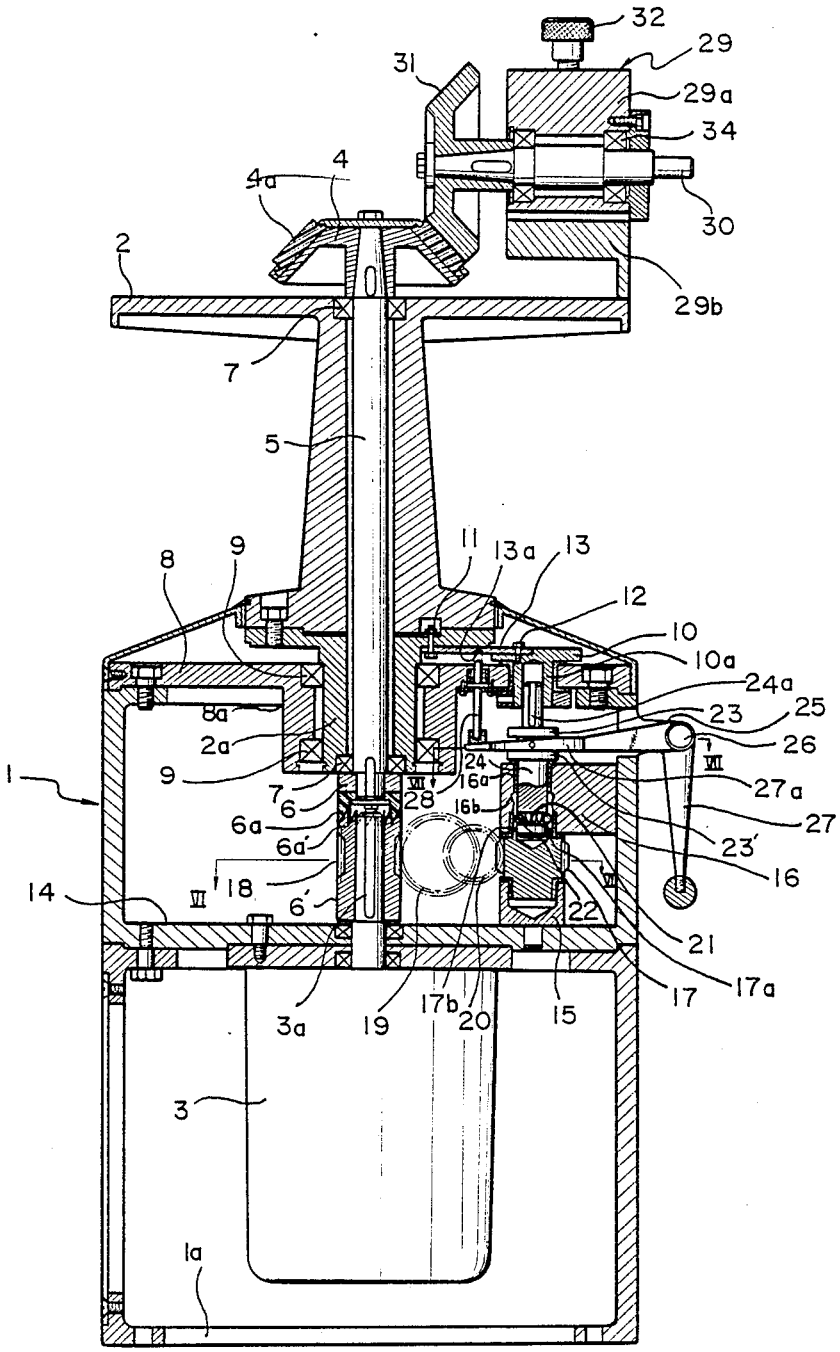
FIG. 1 is a front, sectional view of the drive mechanism of an embodiment of an electric fan apparatus according to the present invention, only one fan spindle being shown in the drawing for illustrative purpose.

Referring to the drawings, wherein the same numerals indicate the same elements in the several drawings.

Figure 2:
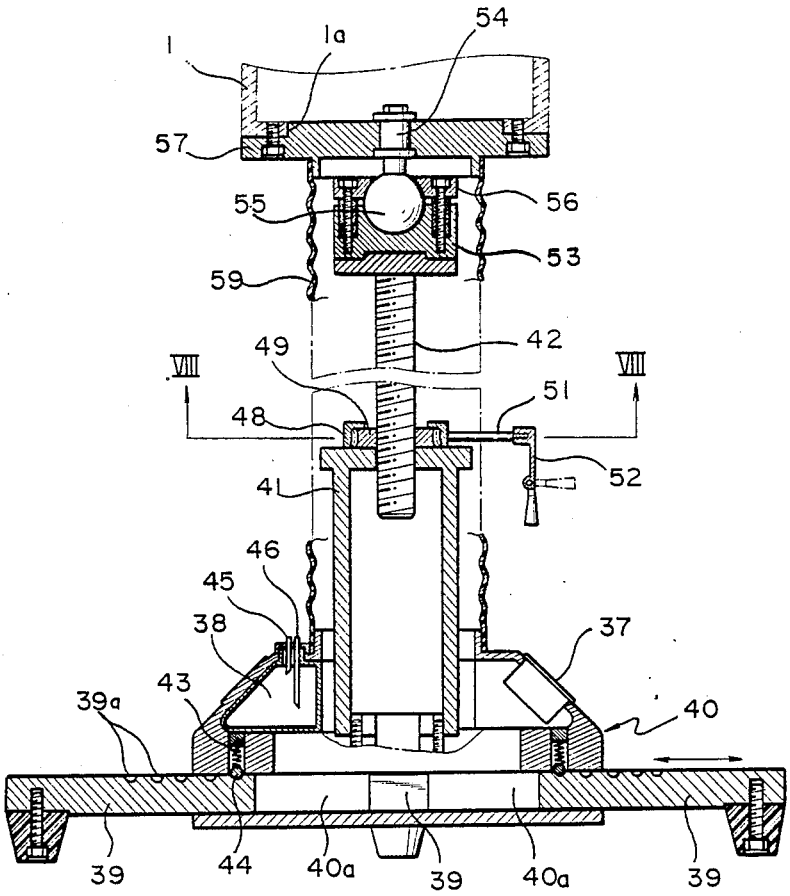
FIG. 2 is a front, sectional view of a stand mechanism of an embodiment of the electric fan apparatus according to the present invention.
Figure 3:
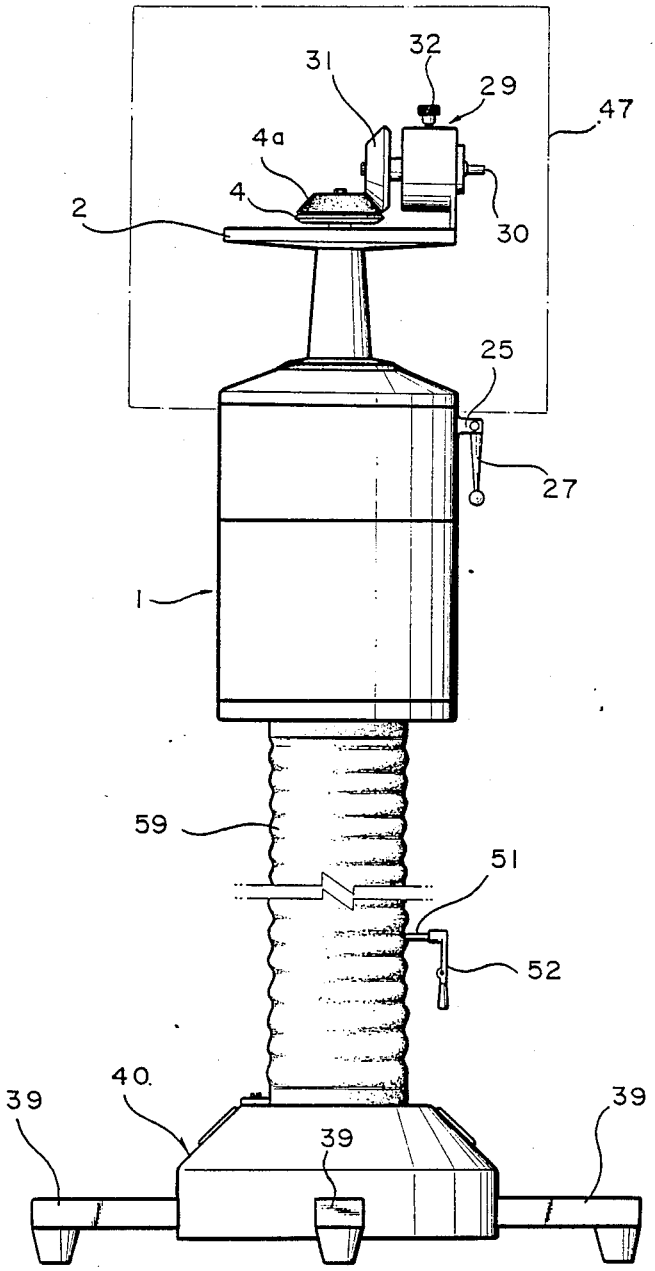
FIG. 3 is a front, elevational view of both the drive mechanism and the stand mechanism of an embodiment of the electric fan apparatus according to the present invention, only one fan spindle being shown in the drawing for illustrative purpose.

As shown in FIG. 1 to FIG. 3, an electric fan apparatus according to the present invention consists of two parts, a driving part and a stand part connected together to form the apparatus.

In FIG. 1, there is depicted the arrangement of the driving part to be connected to the stand part and reference numeral 1 designates a housing having an opening 1*a* on the bottom plate thereof.

A rotary member 2 provided with a extending portion to be connected to a rotatable hub member 2*a* is rotatably secured on the upper central portion of the housing 1 in which a drive motor 3 with a shaft 3*a* is incorporated in the lower portion.

A vertical main shaft 5 is vertically and rotatably provided in the central portion of the rotary member 2, the hub member 2*a* and the housing 1, and then the lower end portion of the main shaft 5 is connected to the motor shaft 3*a* through a pair of claw coupling 6 and 6′ having claw teeth 6*a* and 6*a*′ in correspondence with each other, and one claw teeth 6*a* made of elastic material for absorbing shock occurred during operation. On the upper portion of the main shaft 5, there is fixedly secured a conical friction wheel 4 having a rubber lining 4*a* thereon while the main shaft 5 is fixedly inserted the hub member 2*a* through bearing 7, thereby to be rotated in no relationship with the rotary member 2.

A bearing housing 8*a* is downwardly provided under the surface of a top plate 8 attached to the top surface of the housing 1, and the hub member 2*a* is rotatably inserted into the bearing housing 8*a* through a pair of bearings 9.

On the other hand, a crank disc 10 is provided on one side of the top plate 8 so as to be eccentrically pivoted to a connecting rod 13 by a pin 12 which is pivoted to one side of the hub member 2*a* by a pin 11 for angularly moving the hub member 2*a*.

On the middle portion of the housing 1, there is an intermediate plate 14 provided, on which a supporting member 15 is installed in response to the crank disc 10 and a holding member 16 is provided between the lower shaft portion 10*a* of the crank disc 10 protruded from the top plate 8 and the supporting member 15, and a worm wheel shaft 17 having an internal serration on the top portion thereof is rotatably and vertically installed between the holding member 16 and the supporting member 15.

Between the lower shaft portion 10*a* of the crank disc 10 upper portion of the holding member 16, there is a clutch mechanism provided by which the crank disk 10 may be selectively rotated.

Figure 6:
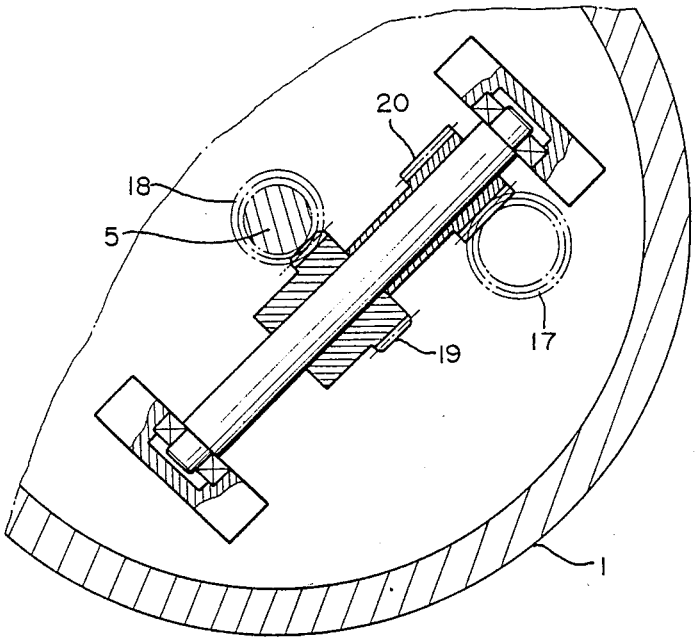
FIG. 6 is a sectional view taken along the line VI—VI of FIG. 1.
Figure 7:
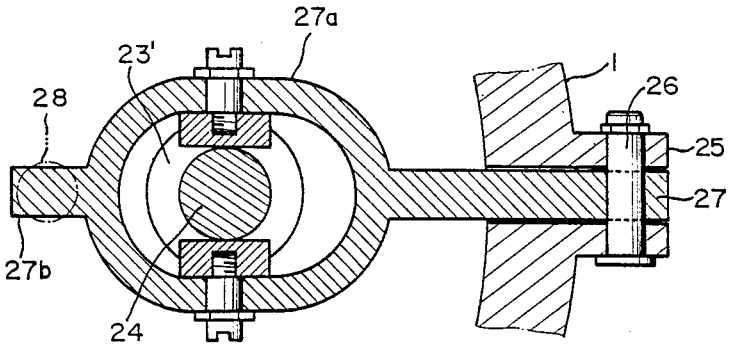
FIG. 7 is a sectional view taken along the line VII—VII of FIG. 1.

As shown in FIG. 6, a worm gear 18 formed on the outer surface of aforesaid coupling 6′ is meshed with a worm wheel 19 fixedly inserted on a horizontal shaft and a worm gear 20 fixedly inserted on the horizontal shaft is meshed with the worm wheel shaft 17. Since the aforesaid worm gear and wheel train are meshed with each other, the rotation of the motor shaft 3*a* will be transmitted to the worm wheel shaft 17.

The clutch mechanism includes a movable shaft 24, a yoke member 27*a* having a manipulating lever 27 and a stop pin 28.

The movable shaft 24 is vertically moved up and down between the shaft portion 10*a* of the crank disc 10 and the serration hole 17*a* formed on the upper portion of the worm wheel shaft 17 through the holding member 16. A plurality of steel balls 22 resiliently urged by a spring 21 horizontally inserted into a lateral hole formed on the lower portion of the movable shaft 24 are selectively engaged with an annular groove 16*b* formed on the internal surface of a vertical hole 16*a* formed in the holding member 16 and on the outer surface of the lower end portion of the movable shaft 24, there is formed a serration 17*b* which can be meshed with the internal serration 17*a* formed on the top portion of the worm wheel shaft 17 for connecting or disconnecting between the movable shaft 24 and the worm wheel shaft 17, and the upper portion having a key 24*a* of the movable shaft 24 is slidably inserted into the hole formed in the shaft portion 10*a* of the crank disc 10.

On the middle portion of the movable shaft 24, there is a pair of flange portions 23 and 23′ provided, whereby an annular groove is formed, and an annular portion of the yoke member 27*a* is movably inserted into the annular groove formed between both flange portions 23 and 23′.

An angular portion of the yoke member 27*a* is pivoted to a supporter protruded from one outside wall of the housing 1 and a manipulating lever 27 is provided to the angular portion.

Further, a stop pin 28 is movably inserted with one end into a hole formed on the bottom surface of the top plate 8 and the other end in contact with an extension portion 27*b* of the yoke member 27*a* so that the stop pin 28 is resiliently urged downwardly by a spring inserted into the hole. On the bottom surface of the connecting rod 13, there are a plurality of holes 13*a* in order that the stop pin 28 can be engaged with one of the holes 13*a* by the operation of the manipulating lever 27.

Figure 4:
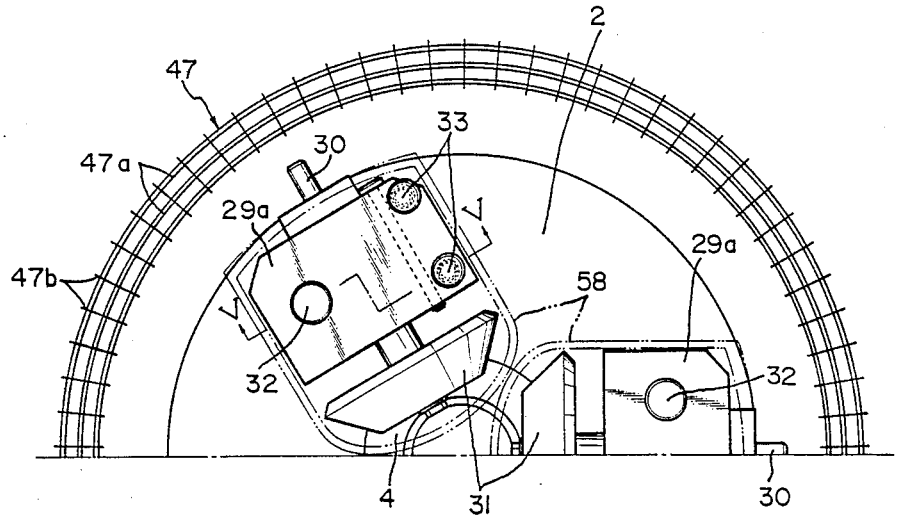
FIG. 4 is a top, plan view showing a first half of the embodiment shown in FIG. 3, the second half of said embodiment being substantially a mirror image of said first half of said embodiment.

As shown in FIG. 1, FIG. 3 and FIG. 4, on the rotary member 2, there are equally disposed a plurality of bearing housing 29 wherein a plurality of fan spindles 30 (e.g. 3 spindles in this embodiment) are provided so as to be rotated in cooperation with the vertical main shaft 5.

Accordingly, a conical follower 31 is fixedly attached e.g., inserted, on one end of each spindle 30 to transfer the rotational driving force from the conical friction wheel 4 fixedly secured on the top portion of the main shaft 5 to each spindle 30, on which fan impellers are securely mounted.

Figure 5:
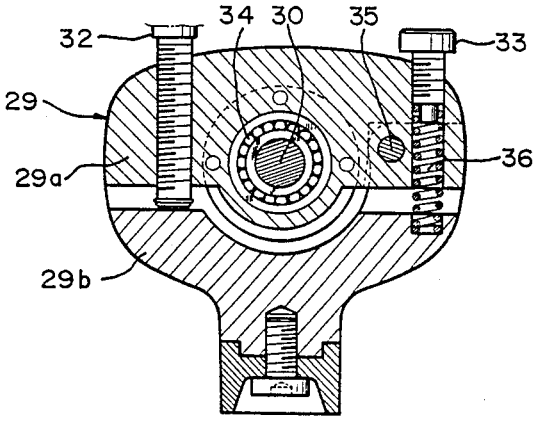
FIG. 5 is a sectional view taken along the line V—V of FIG. 4.

As shown in FIG. 5, the bearing housing 29 consists of two parts, an upper cover 29*a* and a lower base 29*b* which are rotatably associated with each other via a pin 35 and covered with a safety cover 58.

A bearing 34 is provided in the central portion of the bearing housing 29 and therefore, the fan spindle 30 will be smoothly rotated.

The upper cover 29*a* includes adjusting bolts 32 and 33 on the both sides thereof so as to permit the conical follower 31 to be abutted on the conical friction wheel 4.

That is to say, whilst the adjusting bolt 32 is threaded into one side of the upper cover 29*a*, the other adjusting bolt 33 is threaded into the other side of the cover 29*a* by being interposed a spring 36 between the bolt 33 and the lower base 29b so that the upper cover 29a will be resiliently urged to the counterclockwise direction, thereby being subjected to hold the spindle 30.

As shown in FIG. 2, the stand part according to an embodiment of the present invention includes a base member 40 having a plurality of legs 39 being able to adjust their length, a water reservoir 38 formed in the base member 40, a tubular type column 41, a stem member 42 having a tilting device thereon and a height adjustable mechanism thereof.

A plurality of the legs 39 are movably inserted into passage 40a formed in the lower portion of the base member 40 in cross type and have a plurality of engaging depressions 39a on the top surfaces of the legs 39 so that a steel ball 44 resiliently urged by a spring 43 is engaged with one of the depressions 44 for stabilizing the apparatus.

The water reservoir 38 formed in the base member 40 includes a heating device (not shown), a water leveling device (not shown) and water inlet and outlet pipes 45 and 46 which will be respectively connected to one end of circulating pipe 47a of a circular type radiator 47 having a plurality of fins 47b and to be removably installed surrounding the apparatus for supplying hot water.

A control plate 37 positioned on the opposite side to the water reservoir 38 has a plurality of adjusting knobs thereon for operating the driving units and water heating device.

Figure 8:
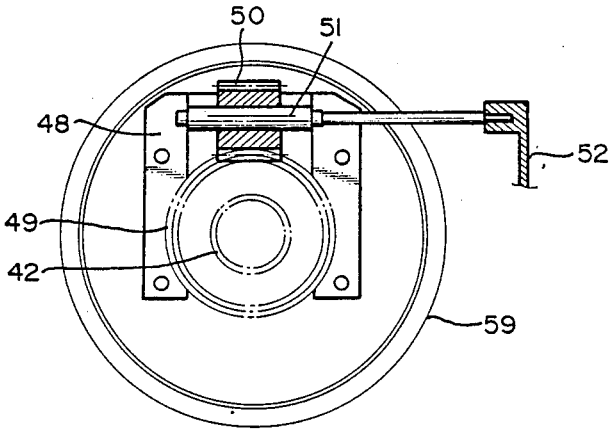
FIG. 8 is a sectional view taken along the line VIII—VIII of FIG. 2.

The column 41 is vertically installed on the central portion of the base member 40 into which the stem member is movably inserted and moreover, the stem member 42 is threaded into the centrum of a worm wheel 48 which is meshed with a worm gear 50 fixedly secured on a shaft 51 rotatably supported by a pair of bracket members 48, and the shaft 51 has an adjusting lever 52 as shown in FIG. 8. Reference numeral 59 designates a bellows type safety hose to be mounted around the stem member 42 and the column 41.

On the other hand, on the top portion of the stem member 42 there is provided a tilting device comprising a ball seat 53 fixedly secured on the top end of the stem member 42, a connecting rod 54 having a ball 55 thereof to be rotatably inserted into the ball seat 53, an upper cover 56 to be fitted to the top surface of the ball seat 53 and a circular plate 54 fixed with one end portion of the connecting rod 57 and to be fitted into the opening 1a of the bottom plate of the housing 1 via bolts or the like.

Described hereunder in detail is the electric fan apparatus operation according to the invention.

The drive motor 3 is actuated to drive the vertical main shaft 5, and therefore the conical friction wheel 4 fixedly inserted on the upper end portion of the vertical main shaft 5 is simultaneously rotated under contact with a plurality of the conical followers 31 (e.g. three conical followers in this preferred embodiment) fixedly inserted on a plurality of the fan spindles 30 which are support by a plurality of the bearing housing 29 equally disposed on the rotary member 2.

Accordingly, a plurality of the conical followers 31 ar rotated by friction force produced between the conical friction wheel 4 and a plurality of the conical followers 31. At that time, the rubber lining 4a covered on the conical friction wheel 4 will enhance the contact effect and will be able to minimize the noise occurred from the friction motion, whereby the rotation of the conical friction wheel 4 can be smoothly and perfectly transmitted to the conical followers 31.

Consequently, each fan spindle 30 is integrally rotated with each conical follower 31, whereby each fan impeller (not shown) to be mounted on each fan spindle 30 will generate wind and send it in directions all around the electric fan apparatus.

On the other hand, the worm gear 18 formed on the outer surface of the coupling 6' fixedly inserted to the motor shaft 3a is simultaneously rotated, and accordingly the worm wheel 19 meshed with the worm gear 18 is rotated to drive the horizontal shaft, thereby rotating the worm gear 20 fixedly inserted to the horizontal shaft.

Since the worm wheel shaft 17 is meshed with the worm gear 20, the worm wheel shaft 17 will be rotated. The movable shaft 24 is rotated by meshing engagement between the serration 17a formed on the top end portion of the worm wheel shaft 17 and the serration hole 17b formed on the lower end portion of the movable shaft 24.

Consequently, the rotating motion will be transmitted to the crank disc 10 in connection between the movable shaft 24 and the lower shaft portion 10a of the crank disc 10, whereby the hub member 2a will be angularly moved by the eccentric movement of the crank disc 10 through the connecting rod 13 pivoted with one end to the hub member 2a and the other end eccentrically pivoted to the crank disc 10.

Thus, the rotary member fixedly secured to the hub member 2a will be angularly and repeatedly moved to right and left sides and simultaneously the bearing housings 29 equally disposed on the rotary member 2 will be angularly moved, whereby the fan spindles 30 are angularly moved and also the conical followers 31 are angularly moved on the conical surface of the conical friction wheel 4.

When the fan impellers (not shown) are mounted on the fan spindles 30, the fan impellers can generate wind to send in immediately before all directions e.g. 360 degrees.

Further, the tilting device makes the wind direction up and down by means of rotating engagement between the ball seat 53 attached to the stem member 42 and the ball 55 formed to one end of the connecting rod 54 to be fixedly secured on the bottom surface of the housing 1 through the circular plate 27.

Moreover, if the rotary member 2 will not be angularly moved, the manipulating lever 27 is pushed toward one side of the housing 1, whereby the movable shaft 24 is moved upwardly in cooperation with the yoke member 27a and then, the steel balls 22 resiliently urged by the spring 21 are engaged into the annular groove 16b formed on internal surface of the vertical hole 16a of the holding member 16. Consequently, the movable shaft 24 is maintained in the released position in which the movable shaft 24 is disengaged with the worm wheel shaft 17 while the serration 17b is isolated from the serration hole 17a, and the rotating motion of the worm wheel shaft 17 is not transmitted to the movable shaft 24 and also the crank disc 10 will not be rotated.

At the same time, the extension portion 27b of the yoke member 27a is moved upwardly and simultaneously the stop pin 28 is ascended to the bottom surface of the connecting rod 13 so that the top end of the stop pin 28 will be engaged into one of the holes 13a formed on the bottom surface of the connecting rod 13, whereby the hub member 2a and the rotary member 2 will not be moved.

Thus, each spindle 30 capable of mounting with a fan impeller will not be angularly moved and however each spindles 30 will be only rotated by the friction contact between the conical friction wheel 4 and the conical follower 31 as the aforementioned manner.

As the result, if a fan impeller is mounted on each fan spindle 30, the wind generated by each fan impeller is respectively sent to the desired direction which can be easily selected by the user.

As shown in FIG. 5, each fan spindle 30 is resiliently urged by the spring 36 through the upper cover 29*a* of the bearing housing 29, and therefore, by adjusting the adjusting bolt 32, the extension force of the spring 36 can be so easily adjusted that the conical follower 31 may be strongly abutted on the conical friction wheel 4 for receiving more powerful transmitting power, or the conical follower 31 may be isolated from the conical friction wheel 4 to the released position.

Thus, the fan impellers can be conveniently and selectively driven by the user.

In the height adjustable device as shown in FIG. 2 and FIG. 8, as the worm wheel 49 is meshed with the worm gear 50 fixedly inserted to the shaft having an adjusting lever 52 thereof and simultaneously is threaded with the stem member 42, the stem member 42 may be raised or lowered by means of the adjusting lever 52, and accordingly the height of the apparatus can be easily and smoothly adjusted by the user.

As shown in FIG. 2, the base member 40 has a plurality of adjustable legs 39 therein, and thus the legs 39 will be pulled outside and retreated inside by the user and will be engaged between one of the depressions 39*a* and the steel ball 44 resiliently urged by the spring 43 so as to place the apparatus in the best stabilizing position.

Furthermore, if required, the present invention can be adapted to generate warm air flow for heating a room during winter time.

That is to say, the heating device (not shown) installed on the water reservoir 38 formed in the base member 40 is connected to the electric power by operating one of knobs on the control plate 37 after the water is supplied into the water reservoir 38, and then the inlet pipe 45 and the outlet pipe 46 are connected to the circular type radiator 47 installed surrounding a plurality of the fan impeller fixedly inserted on the fan spindles 30.

As shown in FIG. 4, the hot water will be circulated into the radiator tubes 47*a*, and therefore the warm air flow will be generated on the peripheral surface of the radiator 47.

Thus, the electric fan apparatus according to the present invention may be adapted to generate warm air and provide heat when desired.

It is to be understood that the forms of the invention herewith shown and described are to be taken as preferred examples of the same, and that various changes in the shape, size and arrangement of parts may be resorted to, without departing from the spirit of the invention or scope of the subjoined claims.

What is claimed is:

1. An electric fan apparatus comprising:

a housing including a rotatable hub member provided in the central portion thereof and surrounded with a bearing housing through a pair of bearings;

a vertical main shaft connected to a motor shaft via a coupling;

a rotary member connected to said hub member;

a plurality of fan spindles equally disposed on said rotary member, and supported by a plurality of bearing housings, respectively;

a base member supporting said apparatus;

a column vertically fixed on the central portion of said base member;

a stem member movably inserted into said column;

a tilting device connected between the bottom plate of said housing and the top end portion of said stem member;

cooperating means between said coupling fixedly inserted to said motor shaft and a worm wheel shaft arranged in said housing;

a clutch mechanism selectively engaging between said worm wheel shaft and a crank device for angularly moving said rotary member; and connecting means transmitting between said main shaft and said plurality of fan spindles capable of being mounted with a plurality of fan impellers for sending the wind to all directions.

2. An electric fan apparatus as claimed in claim 1, wherein said connecting means comprises a conical friction wheel covered with a rubber lining thereon, and fixedly inserted on the top end portion of said vertical main shaft;

a plurality of conical followers to be abutted on said conical friction wheel, and to be fixedly inserted on said each fan spindle, respectively; and a pair of adjusting bolts threaded respectively into the both sides of said each bearing housing including an upper cover pivoted to a lower base by a pin so that one side of side upper cover is resiliently urged by a spring inserted into said bearing housing for contacting said each conical follower to said conical friction wheel, and so that the contact between said each conical follower and said conical friction wheel can be abutted on or isolated from each other by adjusting said adjusting bolts.

3. An electric fan apparatus as claimed in claim 1, wherein said clutch mechanism comprises a movable shaft vertically moved up and down by a yoke member having a manipulating lever between a crank disc and said worm wheel shaft rotated in connection with worm wheel and gear trains for shifting the rotating power to said crank-disc or to releasing position; and a plurality of steel balls resiliently urged by a spring inserted to said movable shaft for engaging with an annular groove formed on internal surface of a vertical hole of a holding member.

4. An electric fan apparatus as claimed in claim 1, wherein said crank device comprises said crank disc provided on one side of the top plate of said housing, and eccentrically pivoted to one end of a connection rod having a plurality of holes thereof and the other end to said hub member; and a stop pin resiliently urged by a spring inserted to a hole formed on said top plate of said housing, and movably inserted with one end into said hole and the other end to be placed on a extending portion of said yoke member so that said stop pin can be engaging into one of said holes of said connecting rod by operating said manipulating lever.

5. An electric fan apparatus as claimed in claim 1, wherein said stem member further comprises a height adjustable device including a worm wheel meshed with a worm gear fixedly inserted on a shaft rotatably supported by a pair of bracket members and simultaneously meshed with said stem member; and an adjusting lever extended from one end of said shaft so that said stem member can be ascended or descend by rotating said adjusting lever.

6. An electric fan apparatus as claimed in claim 1, wherein said base member comprises a plurality of adjustable legs therein which are pulled outside and retreated inside, and can be engaged between one of depressions formed on top surfaces of said legs and each steel ball resiliently urged by each spring so as to place said apparatus in the best stabilizing position.

* * * * *